US005164690A

United States Patent [19]

Yeh et al.

[11] Patent Number: 5,164,690

[45] Date of Patent: * Nov. 17, 1992

[54] MULTI-POLE SPLIT RING RESONATOR BANDPASS FILTER

[75] Inventors: Peter J. Yeh, Sunrise; Branko Avanic, Coral Gables; Leng H. Ooi, Sunrise, all of Fla.

[73] Assignee: Motorola, Inc., Schaumburg, Ill.

[ * ] Notice: The portion of the term of this patent subsequent to May 21, 2008 has been disclaimed.

[21] Appl. No.: 719,449

[22] Filed: Jun. 24, 1991

[51] Int. Cl.[5] ..... H01P 1/203

[52] U.S. Cl. ..... 333/204; 333/203; 333/219; 455/327

[58] Field of Search ..... 333/202, 204, 205, 219, 333/235, 246; 455/326, 327

[56] References Cited

U.S. PATENT DOCUMENTS

| | | | |
|---|---|---|---|
| 4,264,881 | 4/1981 | De Ronde | 333/204 X |
| 4,749,963 | 6/1988 | Makimoto et al. | 333/246 X |
| 5,017,897 | 5/1991 | Ooi et al. | 333/204 |
| 5,021,757 | 6/1991 | Kobayashi et al. | 333/204 X |

FOREIGN PATENT DOCUMENTS

| | | | |
|---|---|---|---|
| 0078201 | 5/1982 | Japan | 333/204 |
| 0038303 | 2/1988 | Japan | 333/204 |
| 286002 | 11/1988 | Japan | 333/204 |

*Primary Examiner*—Eugene R. LaRoche
*Assistant Examiner*—Seung Ham
*Attorney, Agent, or Firm*—Michael J. Buchenhorner

[57] ABSTRACT

A multipole bandpass filter (40) comprises a first microstrip split-ring resonator (12), having at least a first edge and a second edge, the first edge having a gap (20) therein, and an input. The bandpass filter (40) also comprises a second microstrip split-ring resonator (14), having at least a first edge and a second edge, the second edge of the second microstrip split-ring resonator comprising a gap (26) therein and a balanced output (30, 32). The bandpass filter also includes at least one straight line quasi-combline resonator (22), disposed between the first microstrip split-ring resonator, and the second microstrip split-ring resonator.

15 Claims, 3 Drawing Sheets

MULTI-POLE SPLIT RING RESONATOR BANDPASS FILTER

TECHNICAL FIELD

This invention relates generally to bandpass filters (BPFs) and more specifically to BPFs using split ring resonators.

BACKGROUND

Operation of circuits having differential inputs requires balun transformers. At higher frequencies, the insertion loss of the transformers increases. Moreover, if a transformer is not used in a 50 Ohm system (i.e., requiring external matching due to non-standard transformation ratios) the transformer will exhibit a further degradation in insertion loss (IL=2 to 3 dbs in a non-50 Ohm environment). Combining these losses with the filter losses at its input, the overall loss of a 3-pole/-Match/Transformer combination can easily approach IL=5 to 6 dbs. These losses in a receiver front end will have adverse effect. Furthermore, in the frequency range greater than 1 GHz, the use of transformers becomes impractical. Thus, a need exists for a coupling circuit that has differential inputs, outputs, eliminates the need to use a transformer, and provides the capability of n-poles of filtering.

Split ring resonator bandpass filters having a single-ended input port, and a differential-ended output are known. Referring to FIG. 1A, there is shown a two-pole split ring resonator bandpass filter having a single-ended input port, and a differential-ended output, taught in U.S. Pat. No. 5,017,897 to Ooi et al. However, that circuit may not be suitable for circumstances requiring more than two poles of filter selectivity.

Referring to FIG. 1B, there is shown a conventional filter transformer 50 having three interdigital resonators 52, 54, and 56, and a transformer 58. This approach provides a balanced output and three poles of filter selectivity, but suffers from the drawbacks discussed above.

Referring to FIG. 1C, there is shown a three-pole ring resonator 100 having three split-ring resonators, 102, 104, and 106. The capacitors $C_{c1}$ and $C_{c2}$ are coupling capacitors and $C_{t1}$, $C_{t2}$, and $C_{t3}$ are coupled across the gap (or split) in the resonators to reduce their size while maintaining the electrical characteristics of a larger ring. This approach also provides three poles of filter selectively, but suffers from the following problems: (1) high insertion loss; (2) inadequate for balanced operation; and (3) large size.

Therefore, a need exists for a coupling circuit for circuits having differential inputs, that does not require a transformer and that provides more than two poles.

SUMMARY OF THE INVENTION

Briefly, according to the invention, a multi-pole BPF, having an input port and an output port, comprises first and second split-ring resonators. The first split-ring resonator is coupled to the input port of the BPF, and the second split-ring resonator is coupled to the output port of the BPF. The second split-ring resonator comprises a balanced output port. According to the invention, at least one quasi-combline resonator is disposed between the first and second split-ring resonators to provide additional poles of selectivity.

DETAILED DESCRIPTION OF THE PREFERRED EMBODIMENT

Figure 1A:
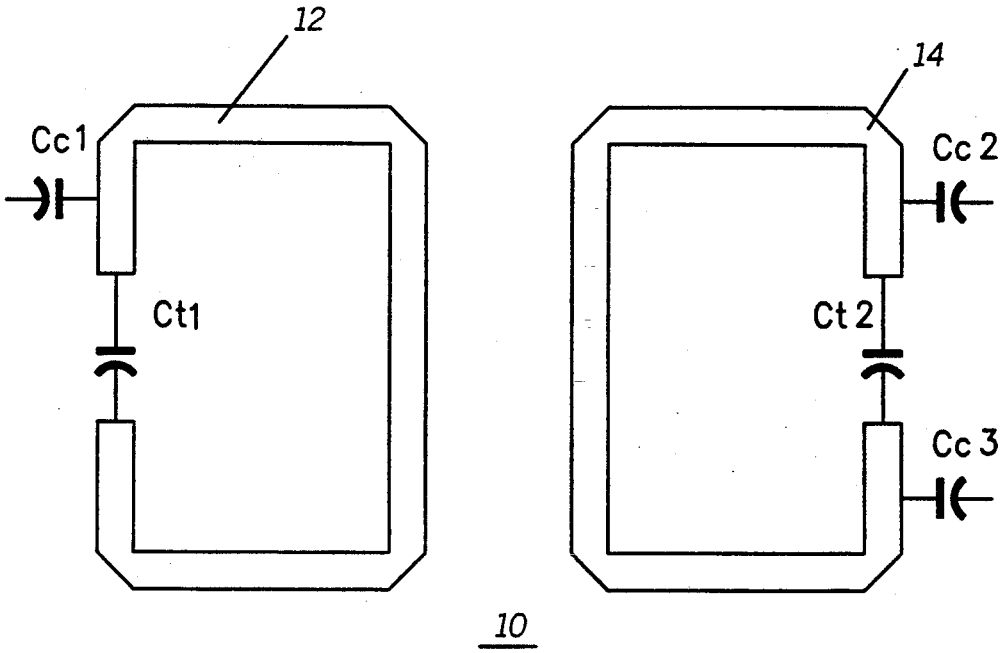
FIG.1A (PRIOR ART)
FIG. 1A shows a known split-ring resonator BPF having a single-ended input port, and a double-ended output port.
Figure 2:
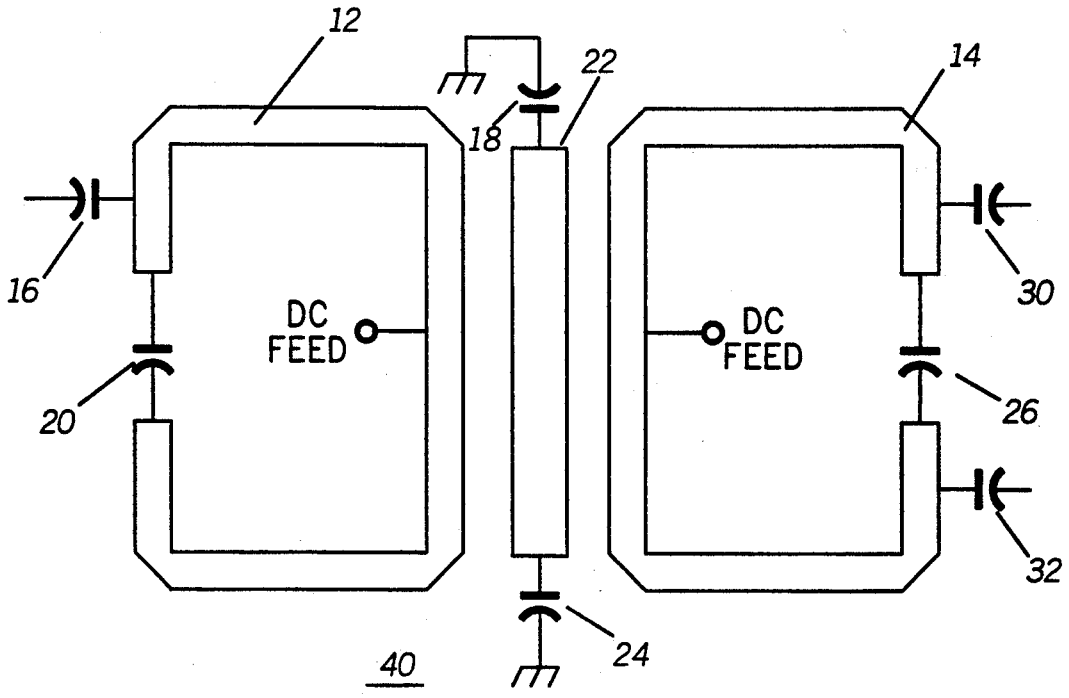
FIG. 2 shows a three-pole BPF having a single-ended input port, and a differential-ended output port, and a quasi-combline resonator, in accordance with the invention.
Figure 1B:
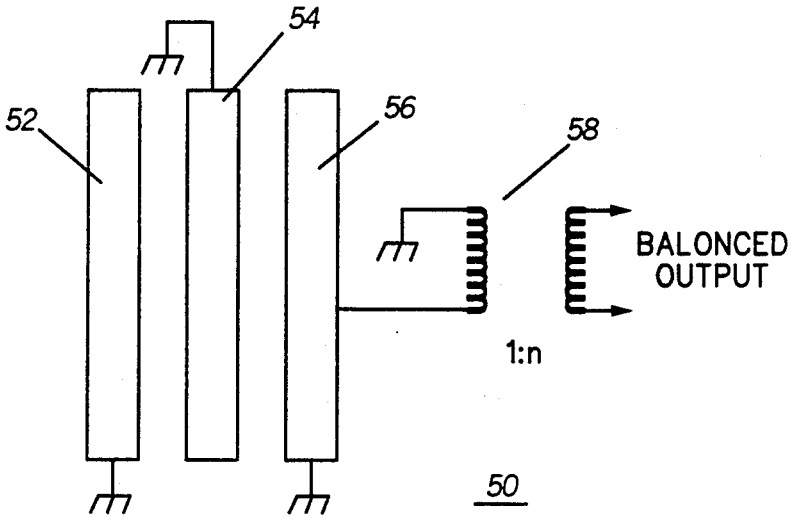
FIG.1B (PRIOR ART)
FIG. 1B shows a conventional filter transformer approach.
Figure 1C:
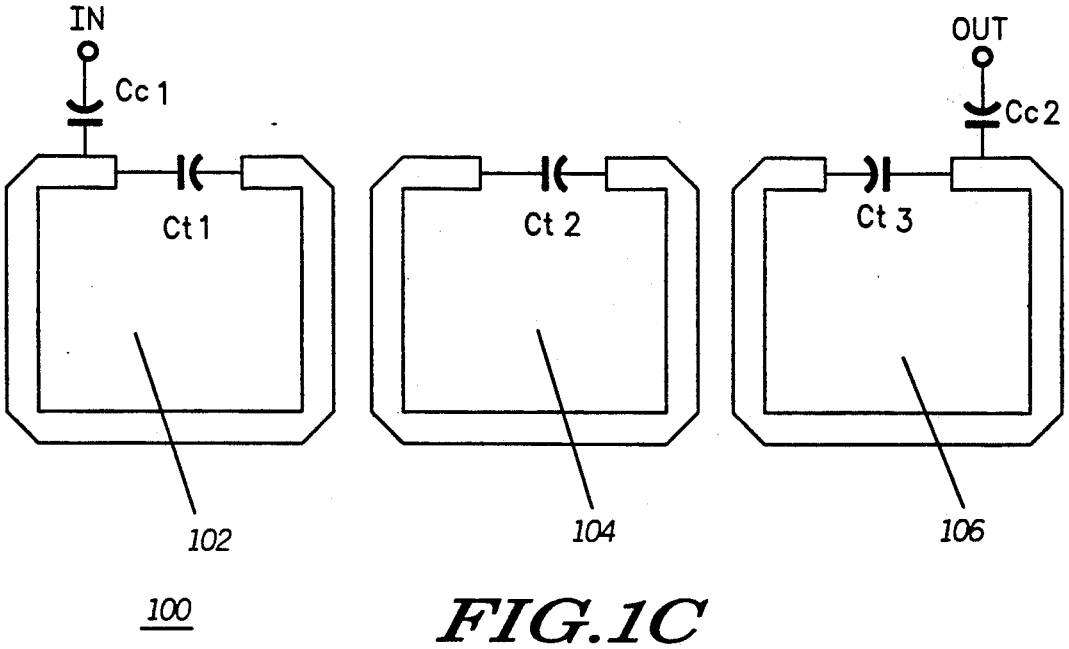
FIG.1C (PRIOR ART)
FIG. 1C shows a 3-pole ring resonator.

Referring to FIG. 2, a three-pole split-ring microstrip or stripline resonator bandpass filter 40 in accordance with the invention is shown. The use of split-ring resonators ensures greater reliability than would be obtained when using a transformer. The bandpass filter (BPF) 40 combines two split ring resonators (12 and 14) with at least one straight line quasi-combline resonator 22. Both the input resonator 12 and the output resonator 14 are of the split-ring configuration in order to provide the balanced capabilities, impedance transformation requirements, and DC feed points through the virtual grounds present at the resonator ends opposite of the gaps. The capacitors 18, 20, 24, and 26 are included for frequency-tuning purposes. The capacitors 16, 30, and 32 are provided for impedance tuning purposes. The capacitors 30 and 32 are optional coupling capacitors, and the best balance is obtained by omitting these capacitors. The inner resonator 22 is what we call a quasi-combline straight half-wave resonator, which is terminated in capacitors (lumped or distributed) at both ends. The capacitors 18 and 24 are used to reduce the length of the resonator 22. This approach enables considerable size reduction, and insertion loss improvements over conventional approaches. The filter 40 has a single-ended input port and a balanced (or differential) output port. However, a filter could also be built having a balanced input and a single-ended output, in accordance with the invention. Moreover, additional poles (and, hence, greater selectivity) may be achieved by introducing additional quasi-combline resonators such as resonator 22 between the split-ring resonators. Compared to the conventional filter-transformer approach of FIG. 1B, the BFP 40 has lower insertion loss because it does not have the losses associated with the transformer 58.

Figure 3:
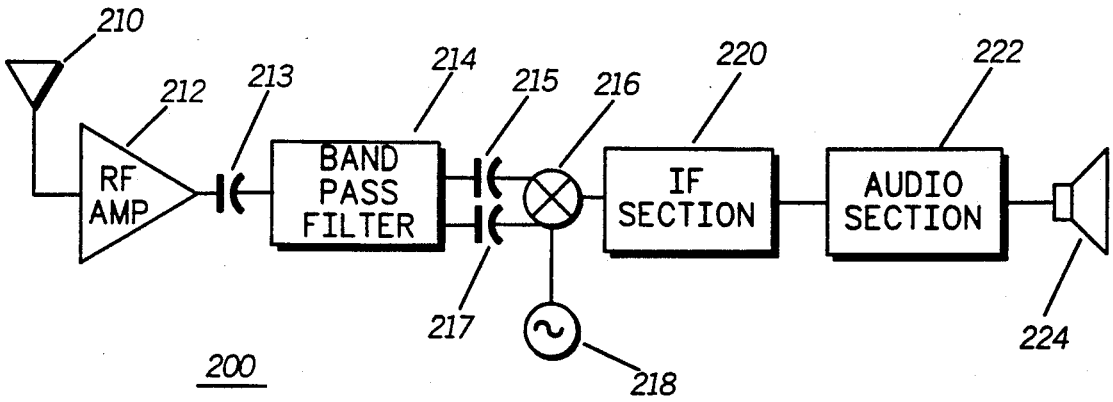
FIG. 3 shows a block diagram of a radio in accordance with the invention.

Referring to FIG. 3, a radio 200 is shown incorporating the RF filter 214 in accordance with the invention. A radio-frequency signal is received at a conventional antenna 210 and amplified by the RF amplifier 212 (an initial bandpass filter coupled from the antenna 210 to the amplifier 212 would also be advantageous). A BPF 214 in accordance with the invention is coupled from the amplifier 212 to a balanced mixer 216 (through a capacitor 213). The bandpass filter 214 is a multi-pole (e.g., 3, 4, or 5 poles) filter to provide the desired selectivity. Greater selectivity is required after the RF amplifier to provide for better image protection. The BPF 214 also has its balanced output port coupled to the balanced input port of the mixer 216 (through capacitors 215 and 217). The signal is then mixed with a reference signal provided by a conventional local oscillator 218 to produce an intermediate frequency (IF) signal. The IF signal is then applied to a conventional IF section 220 where it is processed and demodulated to produce an audio signal. The audio signal is then applied to a conventional audio section 222 and presented to a listener by a conventional speaker 224.

Employing the BPF 214 in such an application improves the performance of the radio 200. However, it will be appreciated that the invention may be advantageously used in other RF parts of radio receivers or transmitters.

Figure 4:
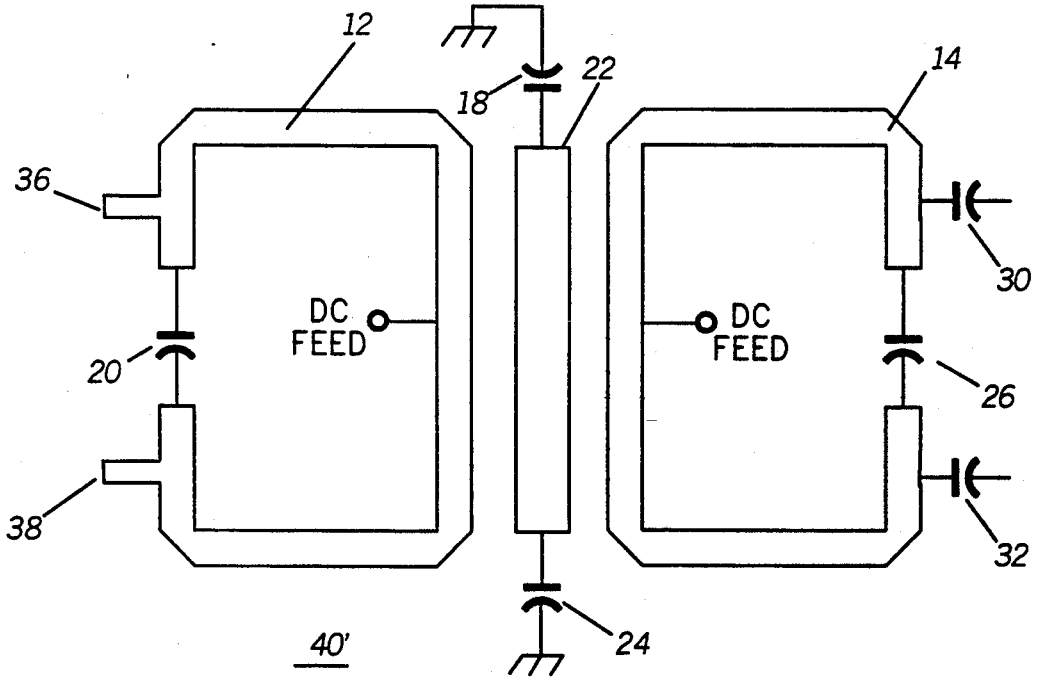
FIG. 4 shows a BPF having a differential-ended input port, and a differential-ended output port, and a quasi-combline resonator, in accordance with the invention.

Referring to FIG. 4, an alternative embodiment of the invention is shown wherein the BPF 40' has a balanced input port and a balanced output port. This is accomplished by eliminating the capacitive input 16 from BPF 40 and introducing terminals 36 and 38 in a manner similar to that used for introduction of the balanced output port of FIG. 2. There are situations where a BPF is required with both a balanced input and a balanced output. By appropriate choice of the location of the taps 36 and 38 the desired phase difference across the inputs may be achieved.

Thus, a split-ring multipole bandpass filter is provided that includes the following advantages over conventional approaches: (1) lower insertion loss; (2) higher selectivity; (3) better amplitude and phase balance; (4) reduced size; (5) more reliability; and (6) impedance transformation.

We claim:

1. A multi-pole bandpass filter, comprising:

a first port;

a first microstrip split-ring resonator, having at least a first edge and a second edge, the first edge having a gap therein, and the first edge being coupled to the first port;

a second microstrip split-ring resonator, having at least a first edge and a second edge, and the second edge of the second microstrip split-ring resonator comprising a gap therein;

a second port coupled to the second edge of the second microstrip split-ring resonator, the second port comprising a first terminal located at one side of the gap in the second edge of the second microstrip split-ring resonator, and a second terminal symmetrically located at the other side of the gap in the second edge of the second microstrip split-ring resonator; and at least one straight line quasi-combine resonator, disposed between the first microstrip split-ring resonator, and the second microstrip split-ring resonator.

2. The bandpass filter of claim 1, further comprising a first capacitor coupled across the gap in the first microstrip split-ring resonator.

3. The bandpass filter of claim 1, further comprising a second capacitor coupled across the gap in the second microstrip split-ring resonator.

4. The bandpass filter of claim 1, wherein the first port comprises a first terminal located at one side of the gap in the first edge of the first microstrip split-ring resonator.

5. The bandpass filter of claim 4, wherein the first port comprises a second terminal symmetrically located at the other side of the gap in the first edge of the first microstrip split-ring resonator.

6. The bandpass filter of claim 1, wherein the at least one straight line quasi-combline resonator comprises:

first and second ends;

a first capacitor disposed between the first end of the at least one straight line quasi-combline resonator, and ground potential; and a second capacitor disposed between the second end of the at least one straight line quasi-combline resonator, and ground potential.

7. The bandpass filter of claim 1, wherein:

the first microstrip split-ring resonator comprises a feed terminal for coupling to a direct current voltage at a virtual ground point in the first microstrip split-ring resonator; and the second microstrip split-ring resonator comprises a feed terminal for couping to a direct current voltage at a virtual ground point in the second microstrip split-ring resonator.

8. A communication device comprising:

receiver means for receiving radio-frequency signals;

a bandpass filter, coupled to the receiver means, comprising:

a first port;

a first microstrip split-ring resonator, having at least a first edge and a second edge, the first edge having a gap therein, and the first edge being coupled to the first port;

a second microstrip split-ring resonator, having at least a first edge and a second edge, and the second edge of the second microstrip split-ring resonator comprising a gap therein;

a second port coupled to the second edge of the second microstrip split-ring resonator, the second port comprising a first terminal located at one side of the gap in the second edge of the second microstrip split-ring resonator, and a second terminal symmetrically located at the other side of the gap in the second edge of the second microstrip split-ring resonator for providing a balanced output for the bandpass filter; and at least one straight line quasi-combline resonator, disposed between the first microstrip split-ring resonator, and the second microstrip split-ring resonator.

9. The communication device of claim 8, wherein the bandpass filter further comprises a first capacitor coupled across the gap in the first microstrip split-ring resonator.

10. The communication device of claim 8, wherein the bandpass filter further comprises a second capacitor coupled across the gap in the second microstrip split-resonator.

11. The communication device of claim 8, wherein the first port comprises a first terminal located at one side of the gap in the first edge of the first microstrip split-ring resonator.

12. The communication device of claim 11, wherein the first port comprises a second terminal symmetrically located at the other side of the gap in the first edge of the first microstrip split-ring resonator.

13. The communication device of claim 8, further comprising a frequency mixer having a balanced input coupled to the balanced output of the bandpass filter.

14. The communication device of claim 8, wherein the at least one straight line quasi-combline resonator comprises:

first and second ends;

a first capacitor disposed between the first end of the at least one straight line quasi-combline resonator, and ground potential; and a second capacitor disposed between the second end of the at least one straight line quasi-combline resonator, and ground potential.

15. The communication device of claim 8, wherein:

the first microstrip split-ring resonator comprises a feed terminal for coupling to a direct current voltage at a virtual ground point in the first microstrip split-ring resonator; and the second microstrip split-ring resonator comprises a feed terminal for coupling to a direct current voltage at a virtual ground point in the second microstrip split-ring resonator.

* * * * *